US009960548B1

(12) United States Patent
Irish et al.

(10) Patent No.: US 9,960,548 B1
(45) Date of Patent: May 1, 2018

(54) MALE CONNECTOR ASSEMBLY WITH MULTIPLE ELECTRIC CONNECTIONS

(71) Applicant: Sumitomo Wiring Systems, Ltd., Yokkaichi, Mie (JP)

(72) Inventors: Danielle Irish, Farmington Hills, MI (US); Will Lyons, Farmington Hills, MI (US)

(73) Assignee: Sumitomo Wiring Systems, Ltd., Yokkaichi-shi, Mie (JP)

( * ) Notice: Subject to any disclaimer, the term of this patent is extended or adjusted under 35 U.S.C. 154(b) by 0 days. days.

(21) Appl. No.: 15/651,480

(22) Filed: Jul. 17, 2017

(51) Int. Cl.

| | |
|---|---|
| ***H01R 24/20*** | (2011.01) |
| ***H01R 13/627*** | (2006.01) |
| ***H01R 13/629*** | (2006.01) |
| ***H01R 13/641*** | (2006.01) |
| *H01R 107/00* | (2006.01) |

(52) U.S. Cl.
CPC ..... *H01R 24/20* (2013.01); *H01R 13/629* (2013.01); *H01R 13/6271* (2013.01); *H01R 13/641* (2013.01); *H01R 2107/00* (2013.01)

(58) Field of Classification Search
CPC ..... H01R 24/20
See application file for complete search history.

(56) References Cited

U.S. PATENT DOCUMENTS 4,072,381 A 2/1978 Burkhart et al.
5,618,201 A * 4/1997 Yagi ..... H01R 13/6275 439/188
5,628,649 A * 5/1997 Yagi ..... H01R 13/6272 439/354
5,938,466 A * 8/1999 Suzuki ..... H01R 13/635 439/352
6,068,507 A * 5/2000 Popa ..... H01R 13/641 439/352
7,331,792 B2 2/2008 Cummings et al.
2010/0248532 A1* 9/2010 Roepke ..... H01R 13/115 439/504
2011/0223790 A1* 9/2011 Hoshino ..... H01R 13/641 439/329
2013/0120000 A1* 5/2013 Kida ..... H01R 13/193 324/538
2013/0221970 A1 8/2013 Miller et al.
2015/0270640 A1 9/2015 Thomas et al.
2016/0233632 A1* 8/2016 Scruggs ..... H01R 13/2421

* cited by examiner

*Primary Examiner* — James Harvey
(74) *Attorney, Agent, or Firm* — Dinsmore & Shohl LLP

(57) ABSTRACT

A connector assembly having a housing configured to hold a plurality of electric connections of different sizes is provided. The connector assembly includes a housing having a plurality of first through-holes and a plurality of second through-holes. The housing includes a plurality of first terminal housings and a plurality of second terminal housings. The first terminal housings are spaced apart from each other so as to define a first axial slot. The terminal positioning assurance includes a spacer configured to be inserted within the first axial slot so as to maintain a fixed spatial relationship between the first terminal housings, the spacer is closed by a terminal housing, so as to prevent water from infiltrating into the first through-holes.

14 Claims, 8 Drawing Sheets

MALE CONNECTOR ASSEMBLY WITH MULTIPLE ELECTRIC CONNECTIONS

TECHNICAL FIELD

The present specification generally relates to connector assemblies, and more particularly connector assemblies configured to house a power connection.

BACKGROUND

Male connector housings are configured to hold a male terminal blade for insertion into a female housing which holds female terminal receivers. The engagement of the male terminal blades in respective female terminal receivers complete an electric connection. FIG. 1 is an illustrative view of a female connector housing 100.

As shown, the female connector housing 100 includes a terminal positioning assurance 102. The terminal position 102 assurance includes a plurality of through-holes 104 which are configured to house female terminal blades (not shown). The female connector housing 100 is configured to engage a male connector housing (not shown) which includes male terminal blades configured to be inserted into the through-holes of the female connector housing so as to complete an electric connection. FIG. 2 is a view taken from the front of the female connector housing 100 shown in FIG. 1.

FIG. 3 is a view of the back of the male connector housing 100 shown in FIG. 1. FIG. 3 shows the back side of five through-holes 104. Wires (not shown) protrude from the backside of the male connector housing. The five through-holes 104 are generally symmetrical to each other, which indicates that each of the male terminal connectors are configured to receive male terminal blades of the same dimension. Further, the through-holes 104 may present an opening for which water may enter.

Accordingly, it remains desirable to have connector housing assembly configured to house multiple electric connections of different sizes and further configured to prevent water from contacting the terminal connections.

SUMMARY

A connector assembly having a housing configured to hold a plurality of electric connections of different sizes is provided. The connector assembly includes a housing having a plurality of first through-holes and a plurality of second through-holes. The diameter of each of the second through-holes is smaller than the diameter of the first through-holes.

The connector assembly further includes a terminal positioning assurance having a wedge configured to be seated within a respective one of the plurality of second through-holes. A sheath having an inner wall bounds the housing and the terminal positioning assurance. A front face of the terminal positioning assurance extends beyond a proximal edge of the sheath.

In one embodiment, the terminal positioning assurance includes a first guide rib. The sheath includes a recess disposed on the inner wall of the sheath and a second guide rib disposed in the recess. The second guide rib is spaced apart from and opposite the first guide rib. The terminal positioning assurance may further include a top rib, wherein the first guide rib is disposed on a side wall of the terminal positioning assurance and the top rib is disposed on a top wall of the terminal positioning assurance and opposite and above the latch.

In one embodiment, the housing includes a plurality of first terminal housings and a plurality of second terminal housings. The first terminal housings are spaced apart from each other so as to define an axial slot. The terminal positioning assurance includes a spacer configured to be inserted within the axial slot so as to maintain a fixed spatial relationship between the plurality of first terminal housings.

In one embodiment of the spacer, the spacer is an elongated member having a bottom wall and a pair of side walls spaced apart from each other so as to form a U-shaped cross-section. The open top the spacer is closed by a terminal housing, so as to prevent water from infiltrating into the first through-holes.

In one embodiment, terminal housing includes a pair of first terminal housings and each of the first terminal housings includes a lip. The lip cooperates with a pair of ramps disposed opposite each other on an inner wall of the terminal positioning assurance. The pair of ramps including a proximal ramp and a distal ramp.

In one instance, the terminal positioning assurance is fitted over the terminal housing so as to engage the lips over the proximal ramps and position the lips between the proximal and distal ramps. In such an instance, the terminal positioning assurance is placed in a pre-stage condition. In another instance, the terminal positioning assurance may be pushed further onto the terminal housing wherein the lips are slid over the distal ramps so as to place the terminal positioning assurance in a locked position. In one embodiment, the distal ramp of one of the pair of ramps is offset from the distal ramp of the other one of the pair of ramps.

In one embodiment, the terminal positioning assurance further includes a plurality of separating walls separating each of the second through-holes from each other. The separating walls are spaced apart from each other and generally orthogonal to the wedge. The housing further includes a plurality of lances. The wedge is configured to slide over a corresponding lance so as to provide a locking engagement between the male and female terminal connectors. The separating walls define the plurality of second through-holes and separate the terminal connections from each other so as to shield the terminal connections from electromagnetic forces generated by the conduction of current through the wires.

Accordingly, a connector housing assembly is provided which is configured to house multiple electric connections of different sizes, prevent water from contacting the terminal connections, help ensure a positive locking condition between the male and female terminal connection and shield the terminal connections from electromagnetic forces.

BRIEF DESCRIPTION OF THE DRAWINGS

The embodiments set forth in the drawings are illustrative and exemplary in nature and not intended to limit the subject matter defined by the claims. The following description of the illustrative embodiments can be understood when read in conjunction with the following drawings, where like structure is indicated with like reference numerals and in which:

DETAILED DESCRIPTION

Referring generally to the figures, embodiments of the present disclosure are directed towards a connector assembly having a housing configured to hold a plurality of electric connections of different sizes. The connector assembly includes a housing having a plurality of first through-holes and a plurality of second through-holes. The diameter of each of the second through-holes is smaller than the diameter of the first through-holes.

The connector assembly may be further configured to generate a secure electric connection between a male and female terminal connector. The connector assembly further includes a terminal positioning assurance having a wedge configured to be seated within a respective one of the plurality of second through-holes so as to generate a pressed engagement between the terminal connections housed therein.

In one embodiment, the terminal positioning assurance includes a first guide rib. The sheath includes a recess disposed on the inner wall of the sheath and a second guide rib disposed in the recess. The second guide rib is spaced apart from and opposite the first guide rib. The terminal positioning assurance may further include a top rib, wherein the first guide rib is disposed on a side wall of the terminal positioning assurance and the top rib is disposed on a top wall of the terminal positioning assurance and opposite and above the latch. Top guide rib, first guide ribs and second guide ribs work together with a male connector to ensure a specific fit. Accordingly, the connector assembly helps ensure a positive electric connection.

The connector assembly may be further configured to help prevent water and debris from penetrating an electric connection disposed within the through-holes. The housing includes a plurality of first terminal housings and a plurality of second terminal housings. The first terminal housings are spaced apart from each other so as to define a first axial slot.

The terminal positioning assurance includes a spacer configured to be inserted within the first axial slot so as to maintain a fixed spatial relationship between the plurality of first terminal housings. In one embodiment of the spacer, the spacer is an elongated member having a bottom wall and a pair of side walls spaced apart from each other so as to form a U-shaped cross-section. The open top the spacer is closed by a terminal housing, so as to prevent water from infiltrating into the first through-holes.

As used herein the terms front and back are made in reference to the orientation of the related part when the retaining system is assembled, wherein the front refers to the portion of the part facing the other during assembly and the back refers to the portion of the part facing away from the front. The term top and bottom refer to the orientation of the part as shown in the figures.

Figure 1:
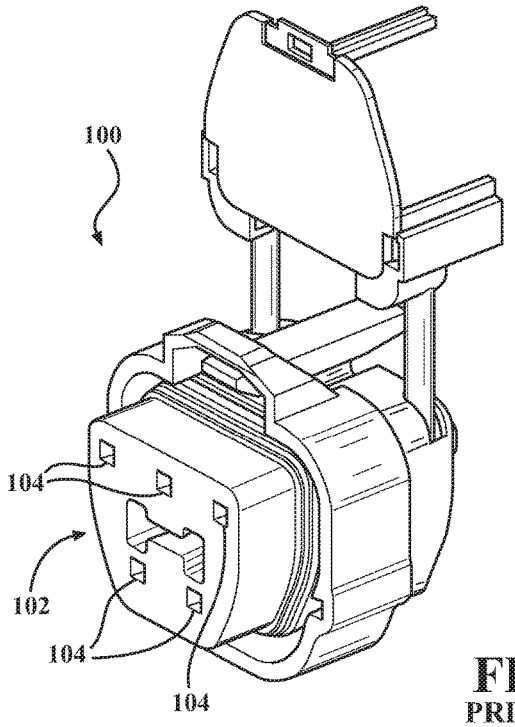
FIG. 1 PRIOR ART
FIG. 1 schematically depicts a connector housing of the prior art.
Figure 2:
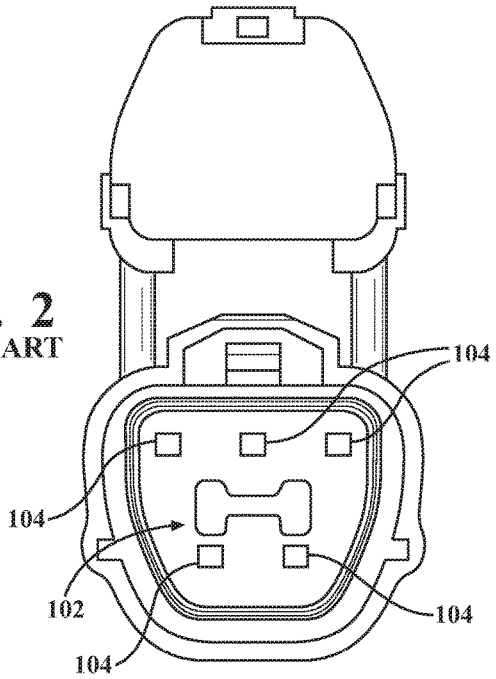
FIG. 2 PRIOR ART
FIG. 2 is a view taken from the front of the male connector housing shown in FIG. 1.
Figure 3:
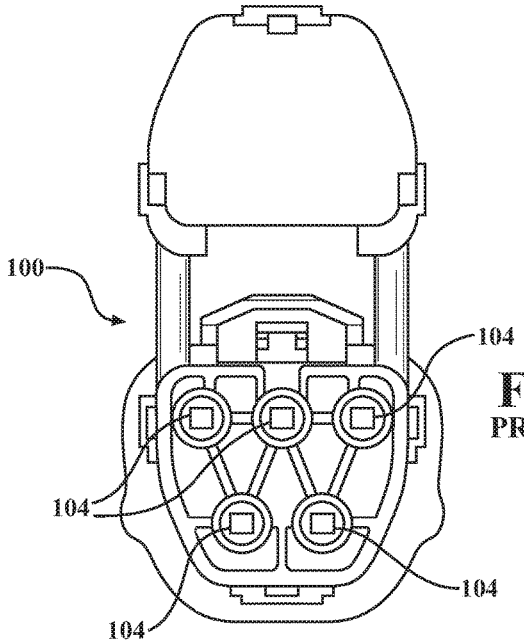
FIG. 3 PRIOR ART
FIG. 3 shows the back side of five through-holes shown in FIGS. 1 and 2.
Figure 4:
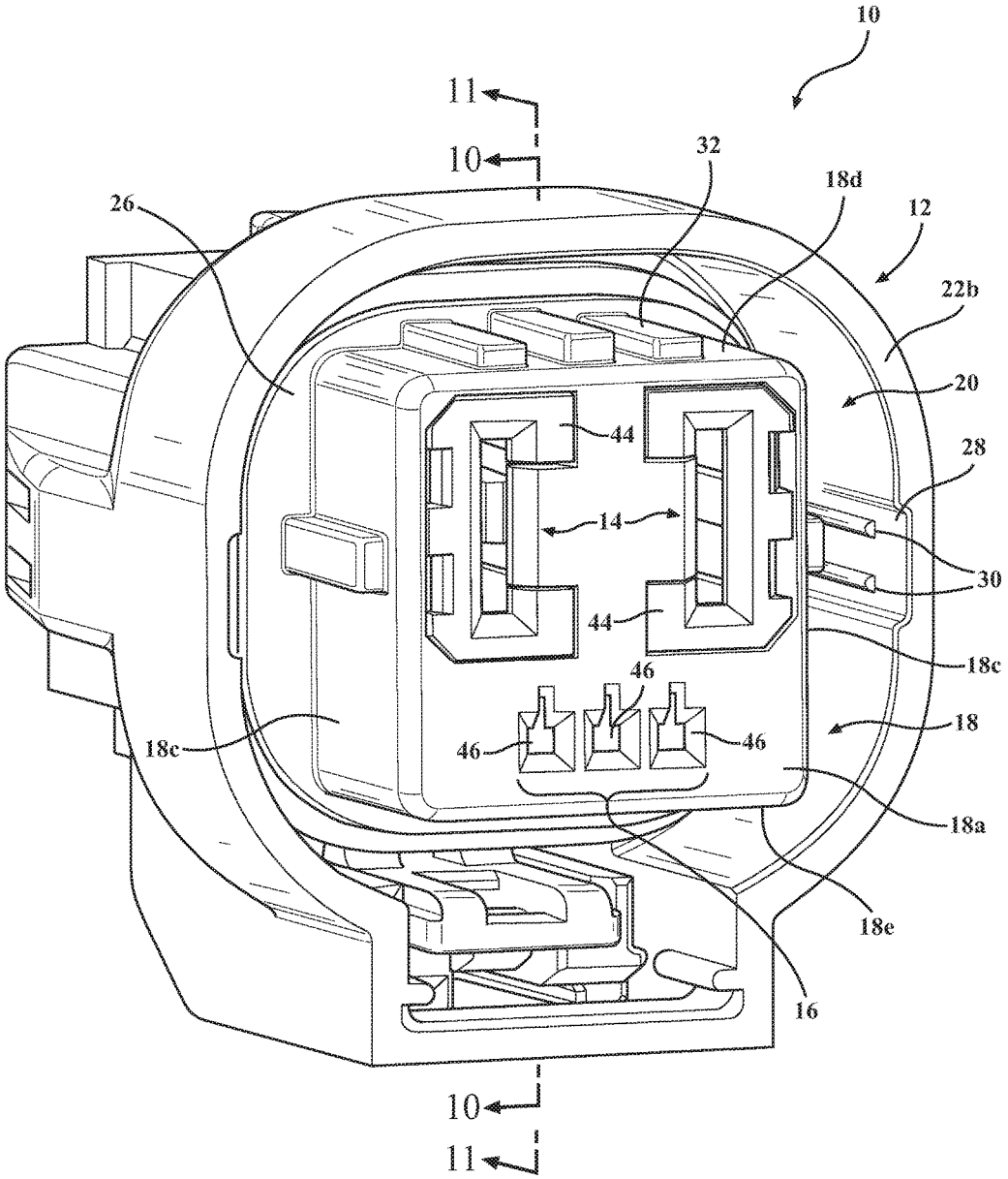
FIG. 4 schematically depicts a connector assembly according to one or more embodiments described and illustrated herein.

With reference now to FIG. 4 an illustrative depiction of a connector assembly 10 according to one or more embodiments described herein is provided. The connector assembly 10 is shown taken from the front. The connector assembly 10 includes a housing 12. The housing 12 includes a plurality of first through-holes 14 and a plurality of second through-holes 16. The diameter of each of the second through-holes 16 is smaller than the diameter of the first through-holes 14. The first through-holes 14 are generally axially aligned to each other. Likewise, the second through-holes 16 are generally axially aligned to each other and parallel to the first through-holes 14.

For illustrative purposes, the first through-holes 14 are configured to house a terminal connection (not shown) having a wire with a diameter of 6.3 mm and the second through-holes 16 are configured to house a terminal connection (not shown) having a wire with a diameter of 0.64 mm. The terminal connection adaptable for use herein is not limiting and may be formed by the coupling of a currently known and used male terminal blade with a currently known and used female terminal blade (not shown), or male and female terminal blades later developed.

The coupling of the male and female terminal blades are made within the first and second through-holes 14, 16. In particular, the male and female blades are mounted within the first and second through-holes 14, 16, whereas the wires electrically coupled to the male and female blades (not shown) extend out of the connector assemblies. The connector assembly 10 described and illustrated herein is configured to be adaptable for use across multiple devices as the connector may accommodate electrical connections for different power demands. Any male or female blades are currently known and used may be adapted for use herein without deviating or limiting the scope of the appended claims.

The first and second through-holes 14, 16 are formed by a terminal positioning assurance 18 and a terminal connector housing 20. The terminal positioning assurance 18 is fitted over the terminal connector housing 20. The terminal connector housing 20 may be integrally formed to the housing 12. The housing 12 further includes a sheath 22 having an inner wall 22*a*. The inner wall 22*a* bounds the terminal connector housing 20 and the terminal positioning assurance 18. A front face 18*a* of the terminal positioning assurance 18 extends beyond a proximal edge of the sheath 22.

The terminal positioning assurance 18 may be cubic and have an open back end (shown generally in FIGS. 6 and 9) so as to receive the terminal connector housing 20. The terminal positioning assurance 18 includes a pair of side walls 18*c*, a top wall 18*d* and a bottom wall 18*e*. The side walls 18*c*, top wall 18*d* and bottom wall 18*e* bound the front face 18*a*. The terminal positioning assurance 18 may further include a first guide rib 24. The first guide rib 24 may be disposed on a side wall 18*c* of the terminal positioning assurance 18.

In one embodiment, the terminal positioning assurance 18 includes a pair of first guide ribs 24. Each of the first guide ribs 24 are disposed opposite of each other on opposing side walls 18*c*. The first guide ribs 24 may be mounted to a plate 26 bounding a distal edge of the terminal positioning assurance 18. A proximal end of the first guide rib 24 may be recessed from the plane defined by the front face 18*a* of the terminal positioning assurance 18.

The sheath 22 includes a recess 28 disposed on the inner wall 22*a* of the sheath 22. The sheath 22 may further include a second guide rib 30. The second guide rib 30 may be disposed in the recess 28. In one embodiment, the sheath 22 includes a pair of second guide ribs 30 disposed in the recess 28. The second guide ribs 30 are spaced apart from each other. A proximal end of the second guide ribs 30 may be displaced from the front edge 22*b* of the sheath 22. The first guide rib 24 is spaced apart from and opposite the second guide rib 30.

The terminal positioning assurance 18 may further include a top rib 32. The top rib 32 is disposed on the top wall 18*d* of the terminal positioning assurance 18 and opposite and above a latch 34. The latch 34 is disposed beneath the terminal positioning assurance 18. A top surface of the top rib 32 is spaced apart from the inner wall 22*a* of the sheath 22. In one embodiment, the terminal positioning assurance 18 includes three top ribs 32. The top ribs 32 are spaced apart from each other. A proximal end of the second guide ribs 30 may be displaced from the front face 18*a*, and a distal edge of the top ribs 32 are integrally molded to the plate 26.

Figure 5:
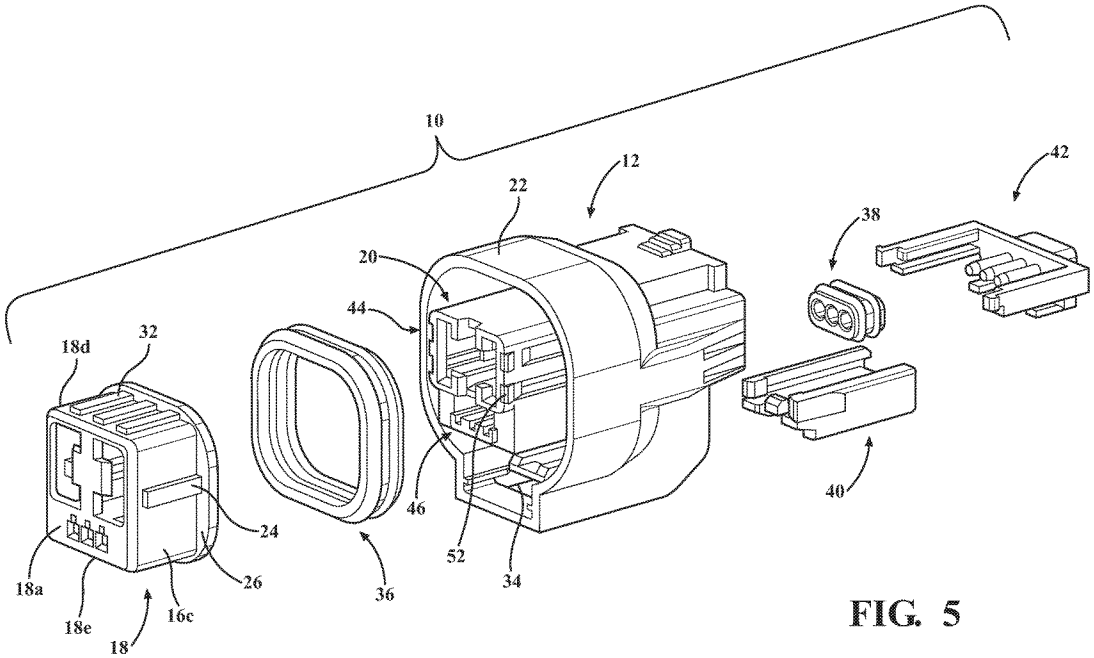
FIG. 5 is an exploded view of the connector assembly shown in FIG. 4.
Figure 6:
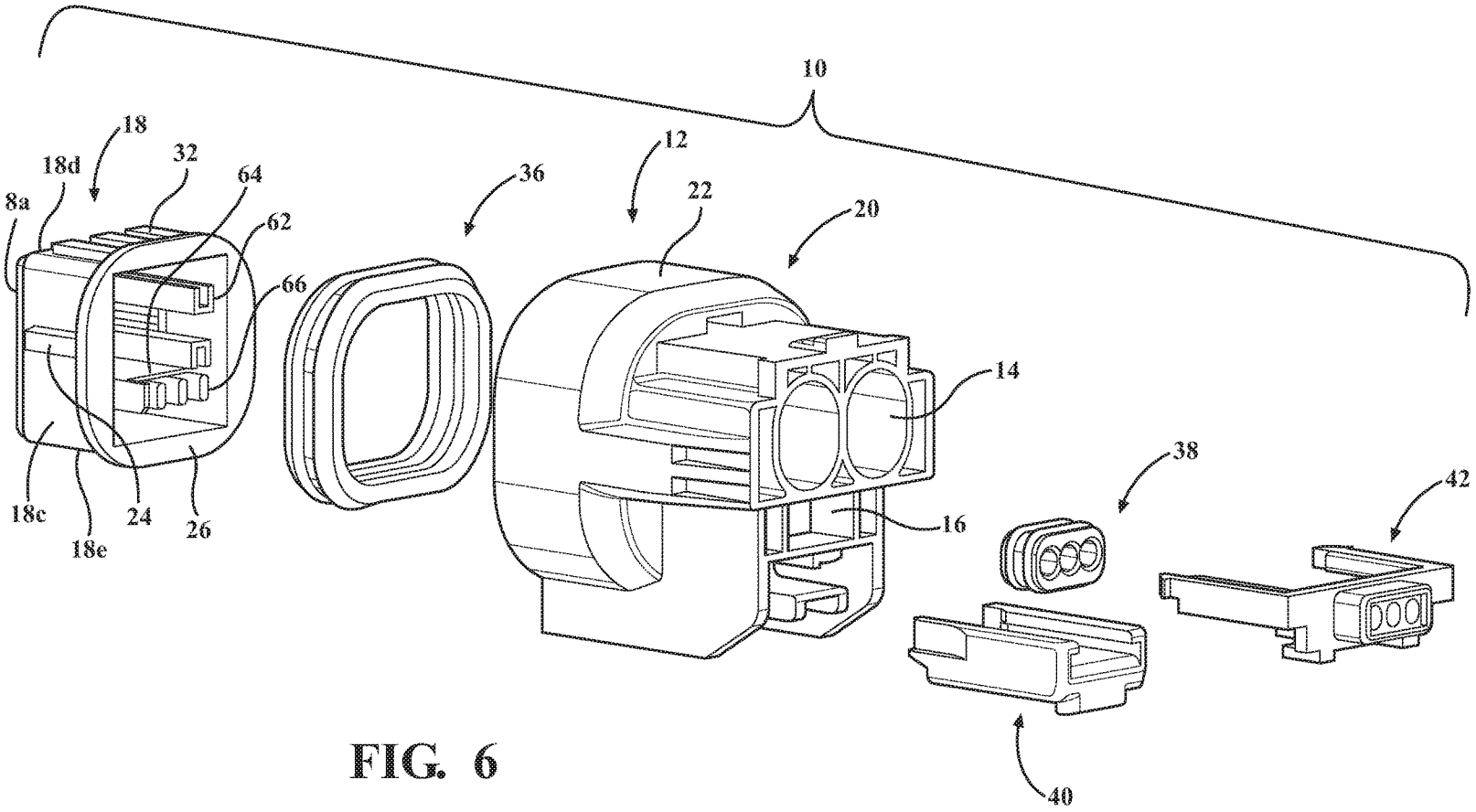
FIG. 6 is a view of FIG. 5 taken from the back of the connector assembly.

FIG. 5 is an exploded view taken from the front of the connector assembly 10. FIG. 5 illustrates how the terminal positioning assurance 18 is mounted onto the terminal connector housing 20 of the housing 12. FIG. 6 is an exploded view taken from the back of the connector assembly 10 showing how the terminal positioning assurance 18 includes features which mate with the terminal connector housing 20.

Figure 8:
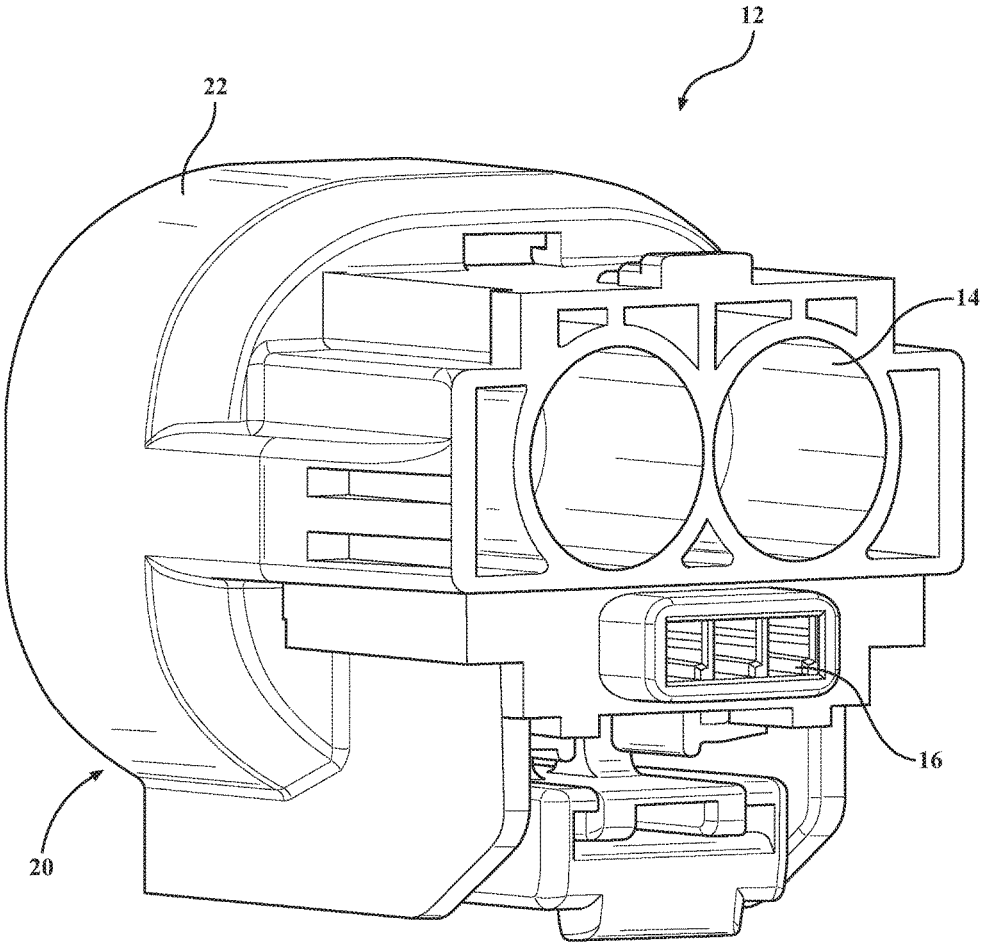
FIG. 8 is view of the housing shown in FIG. 7 taken from the back.

With reference now to both FIGS. 5 and 6, the connector assembly 10 may further include a ring seal 36, a mat seal 38, a connector positioning assurance 40 and a mat seal cover 42. The ring seal 36 is mounted over the terminal connector housing 20 and is pressed by a radial expansion into the sheath 22 when the terminal positioning assurance 18 is mounted onto the housing 12. The mat seal 38 helps prevent water and debris from infiltrating the electric connections housed within the connector assembly 10. FIG. 8 is a view of taken from the back of the connector assembly 10 showing the connector positioning assurance 40 mounted to the latch 34. The distal end of the first through-holes 14 are rounded for accommodating a larger sized wire relative to the second through-holes 16.

The Connector positioning assurance 40 is mounted to the latch 34 and is configured to hold the mat seal cover 42. The mat seal cover 42 is mounted onto the connector positioning assurance 40 and presses against the mat seal 38. As shown, the mat seal cover 42 and the mat seal 38 include apertures which are axially aligned to each other and form a back portion of the second through-holes 16.

Figure 7:
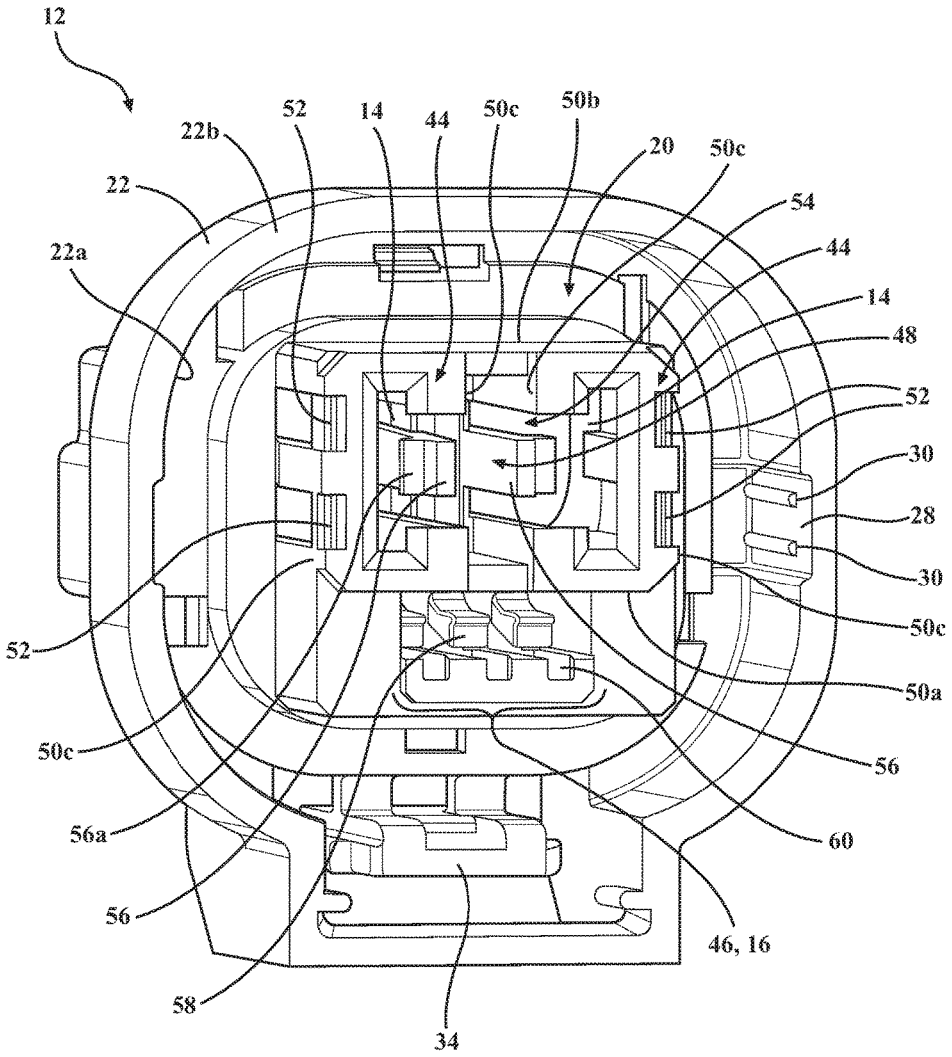
FIG. 7 is an isolated view taken from the front of a housing according to one or more embodiments described and illustrated herein.

With reference now to FIG. 7 an isolated view showing of the housing 12 taken from the front is provided. In one embodiment, the terminal connector housing 20 includes a pair of first terminal housings 44 and three (3) second terminal housings 46. The first terminal housings 44 are spaced apart from each other so as to define an axial slot 48. The first terminal housings 44 are formed from a block 50 so as to have a bottom wall 50*a*, a top wall 50*b* and a pair of side walls 50*c*. The side walls 50*c* closest to the sheath 22, that is on the outer surface of the block 50 includes a pair of slots extending from an open bottom end to a front surface of the first terminal housing 44 so as to form a pair of lips 52.

The inner side walls 50*c*, which are directly opposite of and spaced apart from each other so as to form the axial slot 48, are open so as to define a terminal slot 54. A locking tab 56 is disposed in the terminal slot 54. The locking tab 56 includes a head portion 56*a* disposed on the free end of the locking tab 56. The head portion 56*a* faces the first through-hole 14. The locking tab 56 is a resilient member wherein the head portion 56*a* is configured to press against a terminal connection disposed within a respective first through-hole 14.

The second terminal housings 46 are disposed beneath the bottom wall 50*a* of the block 50 forming the first terminal housings 44. The second terminal housing 46 further includes a plurality of lances 58 disposed above a corresponding second through-hole 16. The lances 58 are elongated resilient members with a nub 58*a* disposed on a free end thereof. The lances 58 are configured to be pressed towards a corresponding second through-hole 16 so as to press against a terminal connection disposed therein so as to help ensure a consistent engagement between male and female terminal blades (not shown).

FIG. 7 illustrates a housing 12 terminal with three second through-holes 16. The lower portion of the second through-holes 16 is formed by a blade slot 60 extending along an axis of a lower portion of the terminal connector housing 20. FIG. 7 illustrates how the second through-holes 16 are configured to hold a wire of a smaller diameter than the wires to be held by the first through-holes 14.

Figure 9:
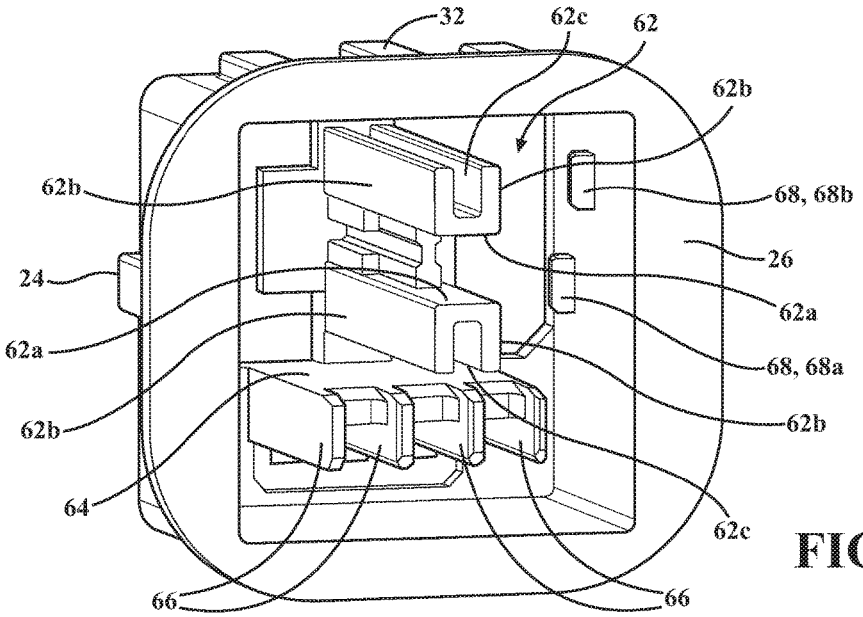
FIG. 9 is an isolated view taken from the back of a terminal positioning assurance according to one or more embodiments described and illustrated herein.
Figure 10:
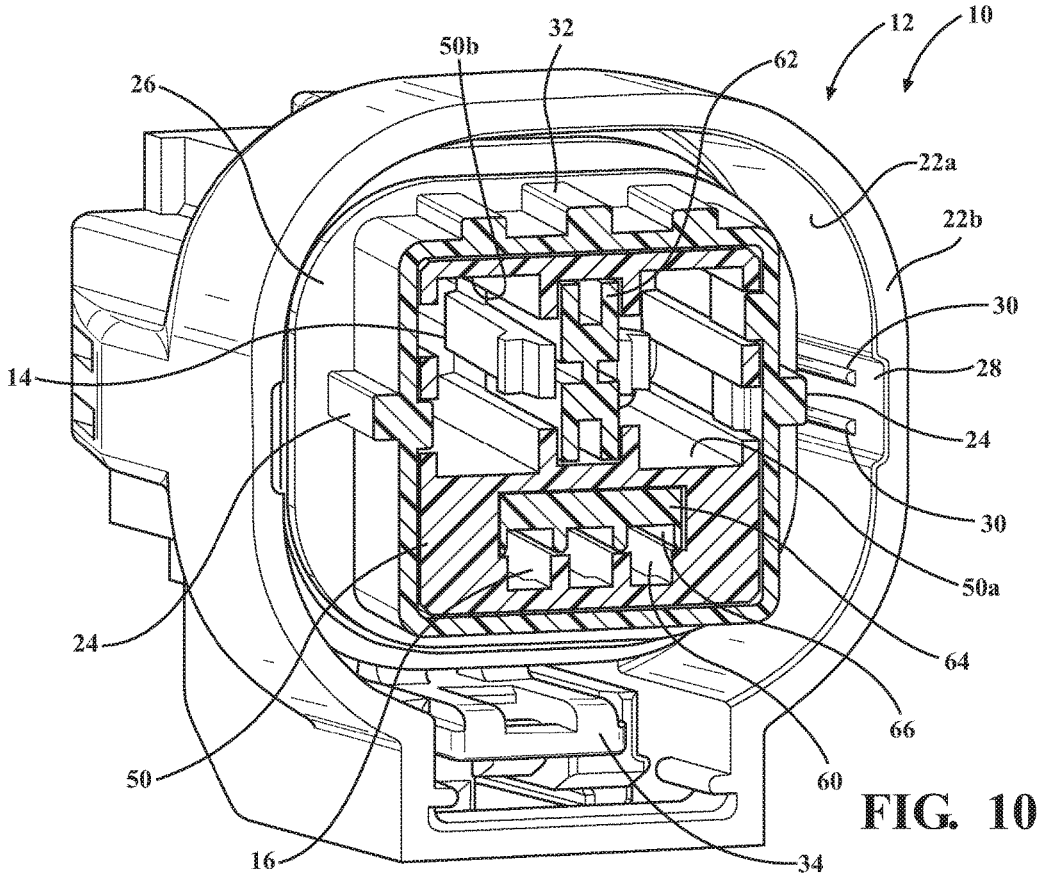
FIG. 10 is a cross-sectional view of the connector assembly shown in FIG. 4 taken along line 10-10.

With reference now to FIG. 9, a view taken from the back of the terminal positioning assurance 18 is provided. The back side of the terminal positioning assurance 18 is open and bounded by the plate 26. The terminal positioning assurance 18 includes a spacer 62. The spacer 62 is an elongated member. With reference to FIGS. 7 and 10, the spacer 62 is configured to fit within the axial slot 48 so as to prevent the inner side walls 50*c* from being bent inwardly with respect to the housing 12. Otherwise stated, the spacer 62 is configured to be inserted within the axial slot 48 so as to maintain a fixed spatial relationship between the plurality of first terminal housings 44.

In one embodiment of the spacer 62, the spacer 62 is an elongated member having a bottom wall 62*a* and a pair of side walls 62*b* spaced apart from each other so as to form a U-shaped cross-section having an open top 62*c*. The open top of the spacer 62 is closed by a top wall of the terminal connector housing 20. Accordingly, the spacer 62 also functions to prevent water from infiltrating into the first through-holes 14. The terminal positioning assurance 18 is shown having two spacers 62, wherein an upper spacer 62 has an open top 62*c* closed by a top wall 50*b* of the terminal connector housing 20 and the bottom spacer 62 has an open top 62 closed by a bottom wall 50*a* of the terminal connector housing 20.

With reference again to FIG. 9, the terminal positioning assurance 18 further includes a wedge 64. The wedge 64 is shown as a generally planar member disposed beneath the spacers 62. With reference to FIG. 7, the wedge 64 is configured to be seated between the bottom wall of the terminal connector housing 20 and a top surface of a respective lance 58. The wedge 64 is configured to have a predetermined thickness wherein the insertion of the wedge 64 between the top surface of the lances 58 and the bottom wall of the terminal connector housing 20 urges the lances 58 towards the corresponding second through-hole 16. The nub 58*a* at the free end of the lances 58 is rounded so as to help facilitate the advancement of the wedge 64 over the top surface of the lances 58.

The terminal positioning assurance 18 further includes a plurality of separating walls 66. The separating walls 66 are configured to separating each of the second through-holes 16 from each other. The separating walls 66 are spaced apart from each other and are generally orthogonal to the wedge 64. The separating walls 66 define the plurality of second through-holes 16 and separate the terminal connections from each other so as to shield the terminal connections from electromagnetic forces generated by the conduction of current through the wires.

With reference again to FIG. 9, the terminal positioning assurance 18 further includes a pair of ramps 68 disposed on each side of the inner wall 18*b* of the terminal positioning assurance 18. FIG. 9 only shows one of the pair of ramps 68 as the other pair of the pair of ramps 68 is hidden. The pair of ramps 68 includes a distal ramp 68*a* and a proximal ramp 68*b*. The distal ramp 68*a* is closer to the front face 18*a* of the terminal positioning assurance 18 and disposed beneath the proximal ramp 68*b*. With reference to FIG. 10, the pair of ramps 68 are configured such that the distal ramp 68*a* of one of the pair of ramps 68 is offset from the distal ramp 68*a* of the other one of the pair of ramps 68. In particular, the bottom lip 52 of one of the first terminal housings 44 is forward of the distal ramp 68*a* and the top lip 52 of the other one of the first terminal housings 44 is forward of the distal ramp 68*a*. Such an arrangement helps distribute the compressive forces so as to help ease the insertion of the terminal positioning assurance 18 in a locked condition.

The lip 52 cooperates with a pair of ramps 68 disposed opposite each other on an inner wall 18*b* of the terminal positioning assurance 18. In one instance, the terminal positioning assurance 18 is fitted over the terminal connector housing 20 so as to engage the lips 52 over the proximal ramps 68 and position the lips 52 between the proximal and distal ramps 68. In such an instance, the terminal positioning assurance 18 is placed in a pre-stage condition. In another instance, the terminal positioning assurance 18 may be pushed further onto the terminal connector housing 20 wherein the lips 52 are slid over the distal ramps 68 so as to place the terminal positioning assurance 18 in a locked position.

Figure 11:
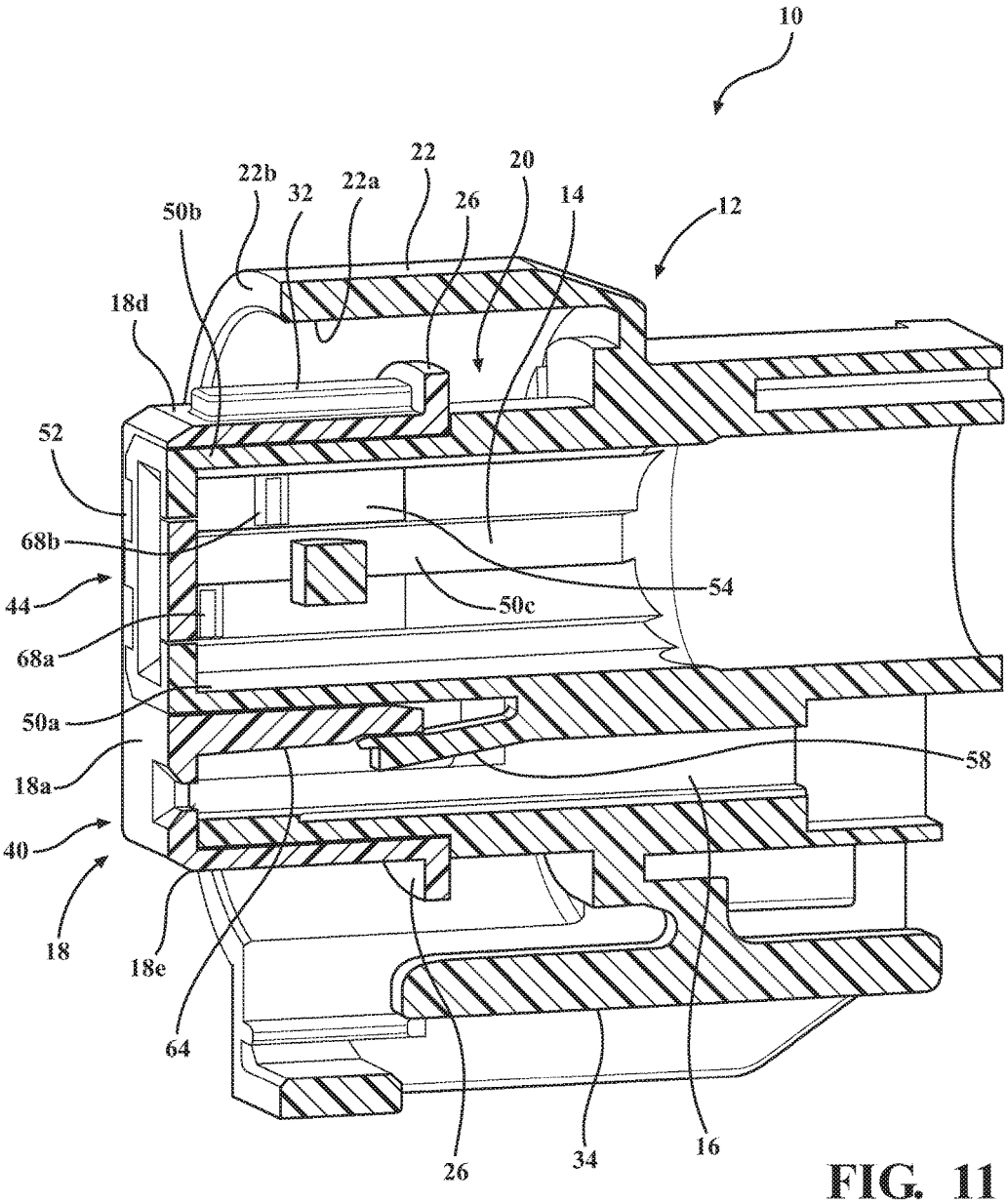
FIG. 11 is a cross-sectional view of the connector assembly shown in FIG. 4 taken along line 11-11.

With reference now to FIGS. 10 and 11, the terminal positioning assurance 18 is configured to engage the housing 12 in a pre-stage condition and a locked condition. FIGS. 10 and 11 show the terminal positioning assurance 18 in a locked condition, wherein the lips 52 of the first terminal housings 44 are advanced forward of the distal ramp 68*a*. In such a position, the wedge 64 is fully engaged with the lance 58. FIG. 11 shows the wedge 64 pressing the lance 58 downwardly into the second through-hole. In the pre-stage condition, the lips 52 are disposed between the distal ramp 68*a* and the proximal ramp 68*b*, thus placing the wedge 64 just before the lances 58, but retained to the housing 12.

Accordingly, a connector assembly 10 is provided which is configured to house multiple electric connections of different sizes, prevent water from contacting the terminal connections, help ensure a positive locking condition between the male and female terminal connection and shield the terminal connections from electromagnetic forces.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A connector assembly comprising:

a housing having a plurality of first through-holes and a plurality of second through-holes, wherein a diameter of each of the plurality of second through-holes is smaller than a diameter of each of the plurality of first through-holes;

a terminal positioning assurance having a wedge configured to be seated within a respective one of the plurality of second through-holes; and a sheath having an inner wall, the inner wall bounding the housing and the terminal positioning assurance, wherein a front face of the terminal positioning assurance extends beyond a proximal edge of the sheath.

2. The connector assembly as set forth in claim 1, wherein the plurality of first through-holes are axially aligned with each other and wherein the plurality of second through-holes are axially aligned with each other, wherein the plurality of first through-holes are generally parallel to the plurality of second through holes.

3. The connector assembly as set forth in claim 1, wherein the housing includes a latch disposed beneath the terminal positioning assurance.

4. The connector assembly as set forth in claim 3, wherein the terminal positioning assurance includes a first guide rib.

5. The connector assembly as set forth in claim 3, wherein the sheath includes a recess disposed on the inner wall of the sheath.

6. The connector assembly as set forth in claim 5, wherein the sheath further includes a second guide rib disposed in the recess.

7. The connector assembly as set forth in claim 4, wherein the terminal positioning assurance further includes a top rib, wherein the first guide rib is disposed on a side wall of the terminal positioning assurance and the top rib is disposed on a top wall of the terminal positioning assurance and opposite and above the latch.

8. The connector assembly as set forth in claim 3, wherein the terminal positioning assurance includes a first guide rib, and wherein the sheath includes a recess disposed on the inner wall of the sheath, the sheath further including a second guide rib disposed in the recess, wherein the second guide rib is spaced apart from and opposite the first guide rib.

9. The connector assembly as set forth in claim 1, wherein the housing includes a plurality of first terminal housings and a plurality of second terminal housings, wherein each of the plurality of first terminal housings are spaced apart from each other so as to define a first axial slot, and the terminal positioning assurance includes a spacer configured to be inserted within the first axial slot so as to maintain a fixed spatial relationship between the plurality of first terminal housings.

10. The connector assembly as set forth in claim 9, wherein the spacer is an elongated member having a bottom wall and a pair of side walls spaced apart from each other so as to form a U-shaped cross-section.

11. The connector assembly as set forth in claim 9, wherein the housing further includes a locking tab, wherein each of the plurality of first terminal housings includes a first terminal wall spaced apart from a second terminal wall, wherein the second terminal wall includes a terminal slot, the locking tab disposed in the terminal slot.

12. The connector assembly as set forth in claim 11, wherein the plurality of first terminal housings include a lip, and wherein the housing includes a pair of ramps disposed opposite each other on an inner wall of the housing, the pair of ramps including a proximal ramp and a distal ramp, wherein the distal ramp of one of the pair of ramps is offset from the distal ramp of the other one of the pair of ramps.

13. The connector assembly as set forth in claim 9, wherein the terminal positioning assurance further includes a plurality of separating walls separating each of the plurality of second through-holes from each other, wherein the plurality of separating walls are spaced apart from each other and generally orthogonal to the wedge.

14. The connector assembly as set forth in claim 13, wherein the housing further includes a plurality of lances, wherein the wedge is configured to slide over a corresponding one of the plurality of lances, wherein the plurality of separating walls define the plurality of second through-holes.

* * * * *